United States Patent [19]

Le Roy

[11] 4,324,158

[45] Apr. 13, 1982

[54] ILLUMINATED WRENCH

[76] Inventor: Alfred N. Le Roy, 1219 Towpath La., Wilmington, Ill. 60481

[21] Appl. No.: 168,582

[22] Filed: Jul. 14, 1980

[51] Int. Cl.[3] ..... B25B 13/46

[52] U.S. Cl. ..... 81/60; 362/119; 81/479

[58] Field of Search ..... 81/60–63.2, 81/121 R, 121 A, 479; 362/119, 109, 102, 114, 118, 120

[56] References Cited

U.S. PATENT DOCUMENTS

| | | | |
|---|---|---|---|
| 2,134,081 | 10/1938 | Gaede | 362/119 |
| 2,466,342 | 5/1949 | Watts | 362/119 |
| 2,588,288 | 3/1952 | Pohanka | 362/119 |
| 3,532,013 | 10/1970 | Haznar | 81/62 |
| 3,590,235 | 6/1971 | Leo et al. | 81/121 R |
| 3,812,340 | 5/1974 | Brandt | 362/114 |
| 4,253,134 | 2/1981 | Barnaby | 362/119 |

*Primary Examiner*—James L. Jones, Jr.
*Attorney, Agent, or Firm*—Gregory J. Nelson

[57] ABSTRACT

An illuminable wrench of the ratchet type in which the tool handle defines a receptacle for battery cells. A lamp or bulb is retained in the head of the tool and is connected in a circuit to the batteries and may be actuated to illuminate a work area. In one embodiment of the present invention, the bulb is secured in a rotatable assembly adjacent the head so the bulb may be rotatably positioned to direct illumination to the desired work area. In still another embodiment, the battery housing and light are adapted to be detachably secured to a conventional wrench.

4 Claims, 16 Drawing Figures

ILLUMINATED WRENCH

The present invention relates to a tool and more particularly relates to a ratchet wrench having an illumination source associated with the wrench.

Users of tools such as ratchet wrenches often find it necessary to work in relatively confined and poorly lit locations. For example, a mechanic working on an automobile engine may find it necessary to loosen or remove a bolt at a location of poor visibility and the mechanic may experience difficulty in correctly positioning the wrench on the bolt. To assist the mechanic, the mechanic in this situation will often try to illuminate the work area with a flashlight or shop light which is not always suitable since the relative inaccessibility of the work location may not allow the light beam to fully illuminate the work area. Further, when using a flashlight, one of the mechanics hands is occupied holding the flashlight making the positioning and operation of the wrench a difficult, one-handed operation. Accordingly, there exists a need for some type of illumination means to assist the mechanic in illuminating the precise work area which is convenient for the mechanic to use.

U.S. Pat. No. 2,466,342, shows a illuminable ratchet wrench having a light bulb socket in the wrench housing adjacent the ratchet. While this patent represents an advance in the state of the art, certain disadvantages are apparent with the wrench shown in this patent. The light is offset from the ratched stud or lug so the light is not directed upon the workpiece such as another bolt but rather is directed to the side of the workpiece.

Briefly, the present invention provides an illuminated ratchet wrench having a head and a tubular handle for containing battery cells. In one embodiment the ratchet lug or stud is provided with an aperture which receives a light bulb. The light bulb is connected in a circuit to the battery cells and can be operated by a switch on the wrench handle. The center line of the light is coincident with the center of the lug.

In another embodiment, a light associated with a ratchet wrench is disposed in the handle of the wrench below the lug and the light is selectively positionable to direct the beam of light at the proper location on the workpiece. In still another embodiment the invention comprises a battery holder and light which may be removably attached to any conventional ratchet-type wrench when needed.

The illuminated wrench of the present invention will be more fully understood and appreciated from the following description, claims and drawings in which:

Figure 1:
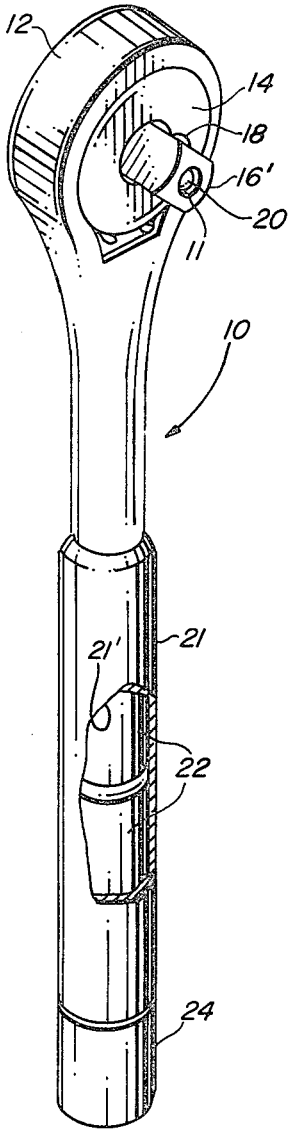
FIG. 1 is a perspective view of a ratchet wrench incorporating a light.

Turning now to the drawings, particularly FIGS. 1 to 7, a ratchet wrench 10 includes a head 12 which houses rotatable drive member 16. Head 12 is integrally connected to handle 21 for manual actuation of the wrench. Handle 21 is shown as being generally cylindrical defining an interior chamber 21' for receiving batteries 22 axially aligned as shown. The lower end of handle 21 is enclosed by removable caps 24 having a spring 28 to provide an upwardly biasing force against batteries 22 in the battery chamber. Switch 26 is located within a recess at the lower end of cap 24 for selectively de-energizing or energizing the circuit.

Figure 3:
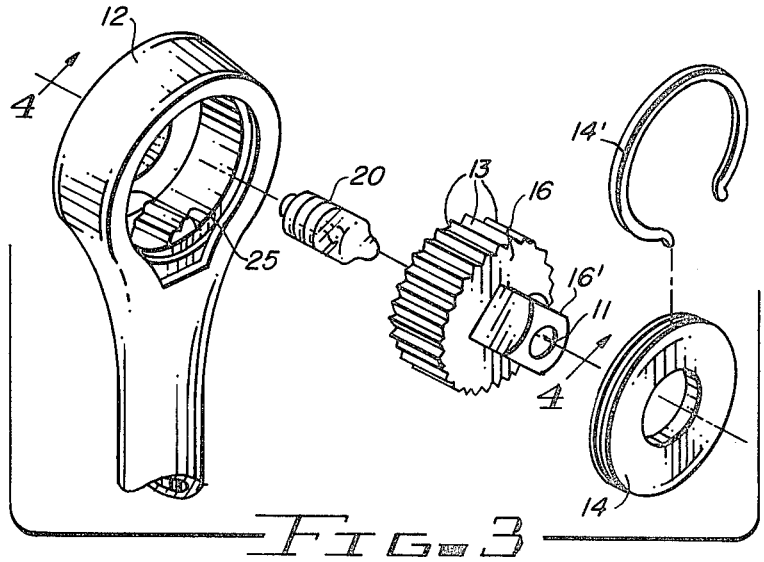
FIG. 3 is an exploded view of the head end of the wrench of FIG. 1.
Figure 4:
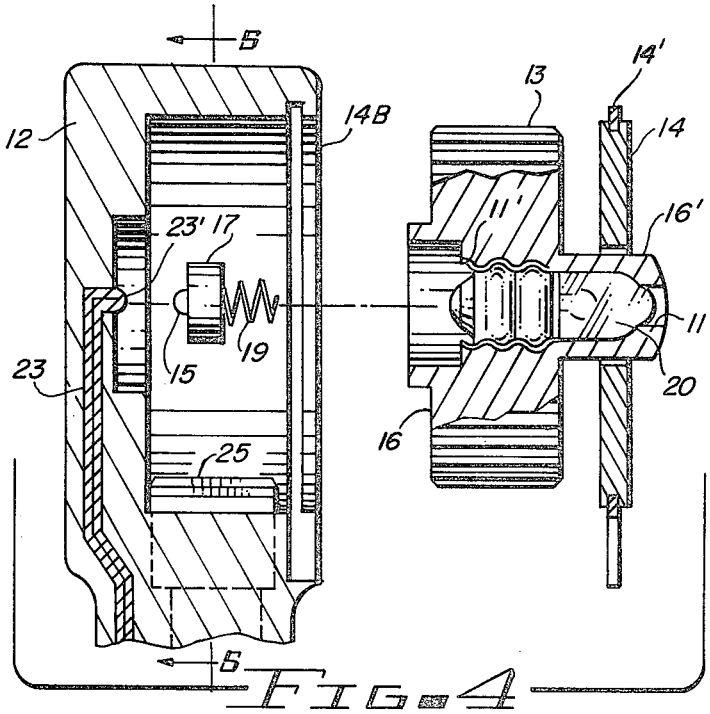
FIG. 4 is a sectional view taken along lines 4—4 of FIG. 3.
Figure 2:
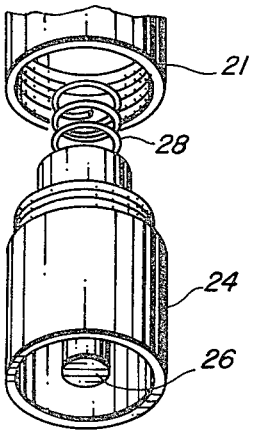
FIG. 2 is a detail perspective view of the lower end of the handle of the wrench.
Figure 5:
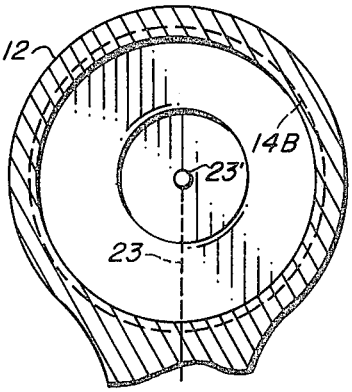
FIG. 5 is a sectional view taken along lines 5—5 of FIG. 4.

Head 12, having a generally annular casing, receives rotatable ratchet drive 16 which is provided with peripheral gear teeth 13 as best seen in FIG. 3. Gear teeth 13 engage reversible pawl member 25 for selective actuation of the drive in either direction of rotation. Rectangular lug or stud 16' projects concentrically from the drive gear 16 to accomodate a socket, extension or other tool and includes a detent 18 spring biased by spring 19 to engage the tool. Drive member 16 is retained in place in recess 14B within the head 12 by annular retaining disc 14 and snap ring 14' which seats in a groove in the head 12. The ratchet construction described above is well-known to those skilled in the art and further detailed description is not believed necessary.

Figure 6:
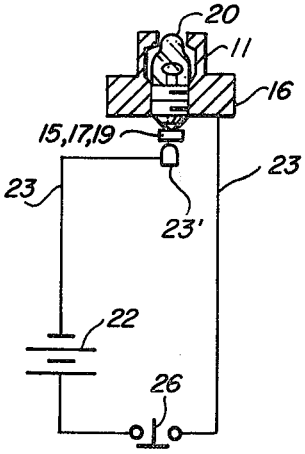
FIG. 6 is a schematic of the electrical circuit.
Figure 16:
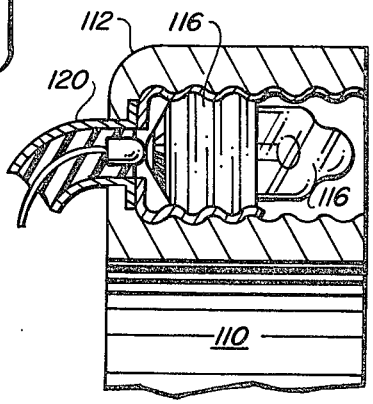
FIG. 16 is an enlarged view of a portion of the head of the wrench as indicated in FIG. 13.
Figure 8:
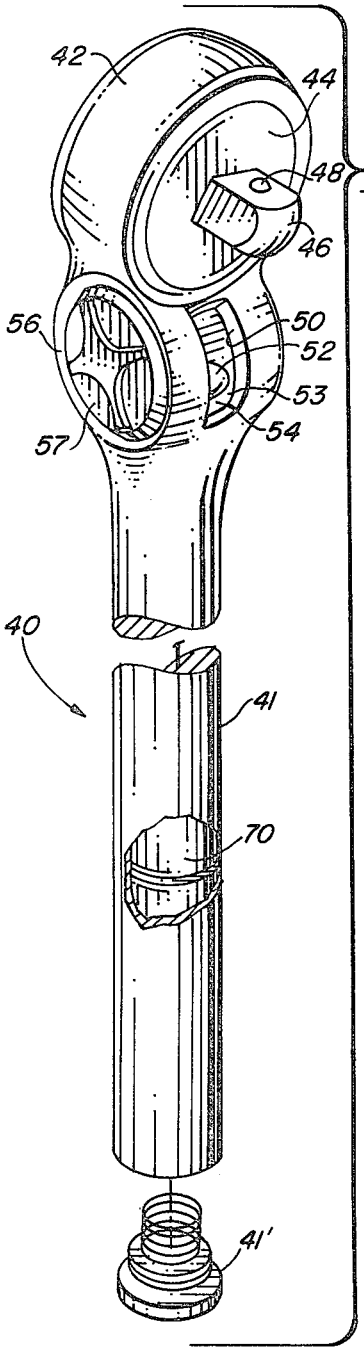
FIG. 8 is a perspective view of another embodiment of the wrench of the present invention.
Figure 7:
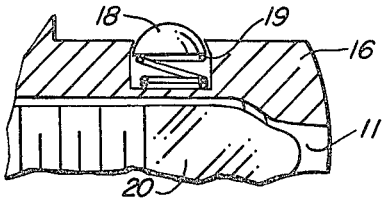
FIG. 7 is a partial sectional view of the wrench lug.

Illumination is provided by means of light source 20 which is shown as a light bulb received in aperture 11 concentrically formed in lu 16'. Aperture 11 has an innersocket portion 11' into which a conventional bulb 20 may be screwed. Conductor 23 extends through a passageway in handle 21 to head 12 and terminates at contact 23'. Contact 23' is axially aligned with the contact on light bulb 20. Spring 19 is carried on a conductor member 17 having contact 15 which is interposed between the contact of the light 20 and conductor 23. It will be apparent that when the wrench is assembled with the drive gear 16 secured within recess 14B of the head of the wrench by disc 14 and snap ring 14', an electrical circuit will be established as shown in FIG. 6. When switch 26 is depressed, the circuit is energized and light source 20 is illuminated. The illumination is coincident with the center of lug 16 so in use the light is directly alignable with the workpiece and assists the mechanic in placing the wrench and associated socket attachment in engagement with the workpiece. When it is not necessary to use the light, the light can be de-energized at switch 26 and the light does not interfere with the normal use of the wrench.

Figure 9:
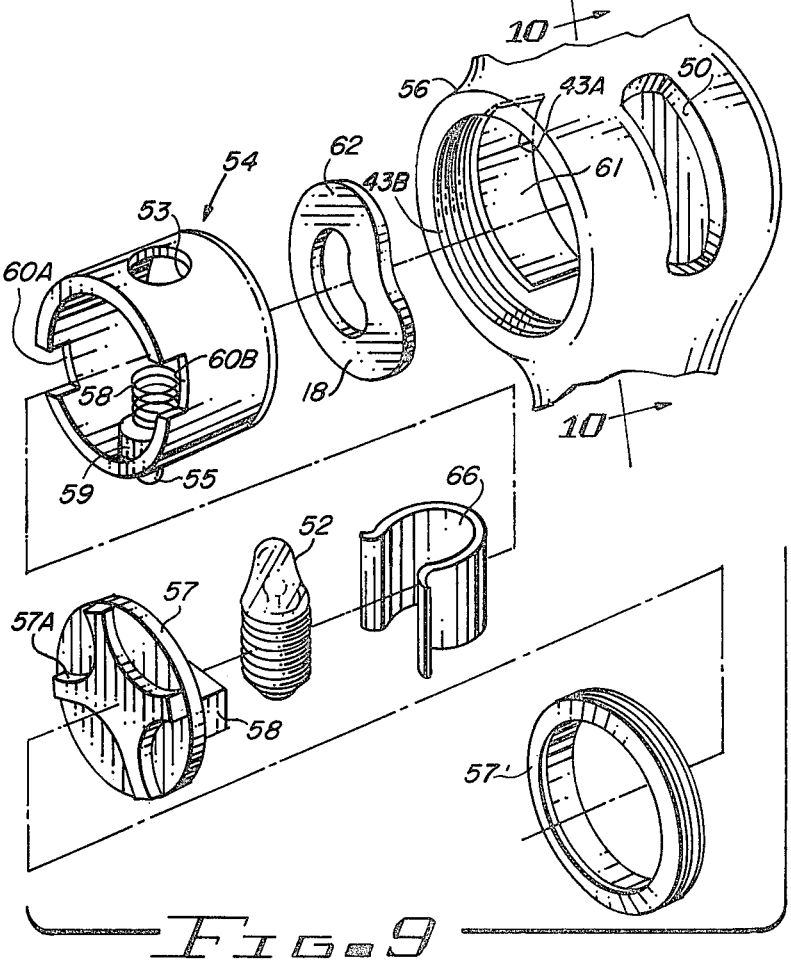
FIG. 9 is an exploded view of the head of the wrench shown in FIG. 8.
Figure 11:
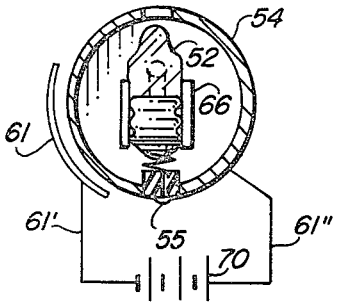
FIG. 11 is a view partly in schematic illustrating the electrical circuit of the embodiment shown in FIGS. 8 to 10.
Figure 10:
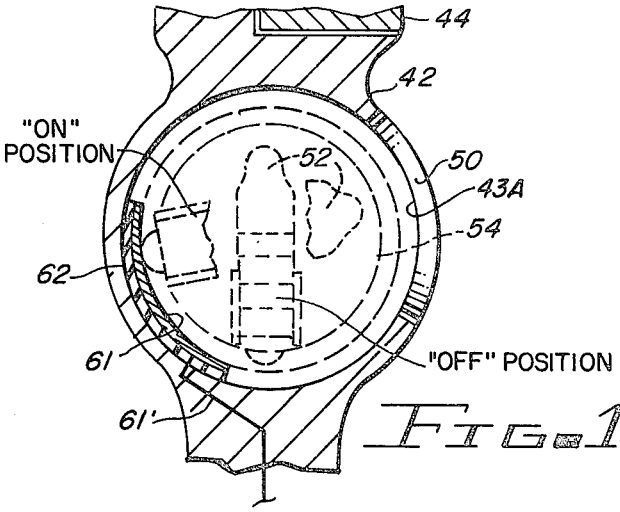
FIG. 10 is a sectional view taken along lines 10—10 of FIG. 9.

An alternate embodiment of the present invention is illustrated in FIGS. 8 through 11 and is generally designated by the numberal 40. Embodiment 40 includes an elongate tubular handle 41 which is hollow and contains a plurality of battery cells 70 as shown. Handle 41 is closed by cap 41'. The upper end of handle 41 carries integral head 42 within which is carried a rotative drive member 44 carrying axially projecting lug or stud 46 having detent 48 for the reception of a socket or extension or other tool. The particular details and construction of the ratchet mechanism have been generally described above and are well-known in the art and need not be set forth in detail. Head 42 is preferably disposed at a forward angle with respect to the axial center line of tubular handle 41. The neck portion 56 intermediate head 42 and handle 41 defines a transversely extending bore 43A which is intercepted by axially extending slot 50. Arcuate contact strip 61 of a conductive material is peripherally disposed within bore 43A with non-conductive pad 62 interposed between strip 61 and bore 43A. Contact 61 is connected in a circuit to battery 70 by electrical conductor 61' and 61'' as best seen in FIGS. 10 and 11.

Cylindrical socket member 54 is rotative within transverse bore 43A. Cylindrical member 54 defines a circular opening 53 which is alignable with slot 50 in neck portion 43. Diametrically opposed slots 60A and 60B are formed at one edge of cylindrical member 54. A bulb 52 is insertable in receptacle 58 of bulb socket 59. Contact 55 is disposed on the outer side of cylinder 54 and, as best seen in FIGS. 10 and 11, when contact 55 is positioned in engagement with contact strip 61, the electrical circuit is completed. Bulb 52 is further secured in place by C-clamp 66 within cylindrical member 54.

Cylindrical socket member 54 and the bulb assembly are rotatable by means of a dial 57 which is shown as a relatively flat disc having transverse projection 58 engaged within opposite slots 60A and 60B of cylinder 54. The outer surface of dial 57 is provided with a raised surface 57A for the convenience of the user.

As best seen in FIG. 9, the light is assembled by first inserting annular wave washer or wave spring 62 into bore 43A. Wave washer 62 exerts an outwardly biasing force against the cylinder 54. Socket 54 is next inserted followed by switch 57A. Switch 57A is rotatable within annular retainer ring 57' which is threaded engagement in peripheral threads 43B of bore 43A.

As best seen in FIGS. 9 and 10, the cylindrical socket member 54 is rotatable to an on-position with contact 55 engaging circumferential contact strip 61. The on-position extends over a substantial arcuate distance as for example approximately 90° of rotation. With the device in the on-position, light bulb 52 and opening 53 in cylindrical member 54 are aligned with axially extending slot 50 in the neck 56 of the wrench. This allows the user to rotate the socket 54 to direct the light emanating from bulb 52 to a work area. Thus the adjustability of the position of the light source 52 will allow the user to adjust the light and direct the light as the light may be focused at a distance and angle to coincide with the work area and location. When the light is not necessary, socket 54 is rotated by means of dial 57 to an off-position with contacts 55 and 61 out of engagement, de-energizing the circuit.

Figure 12:
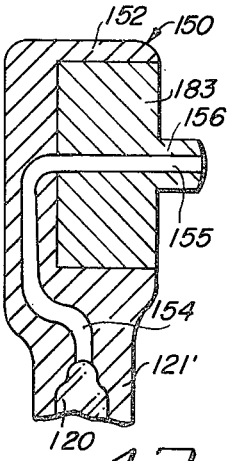
FIG. 12 is a partial sectional view illustrating another embodiment of the present invention.
Figure 13:
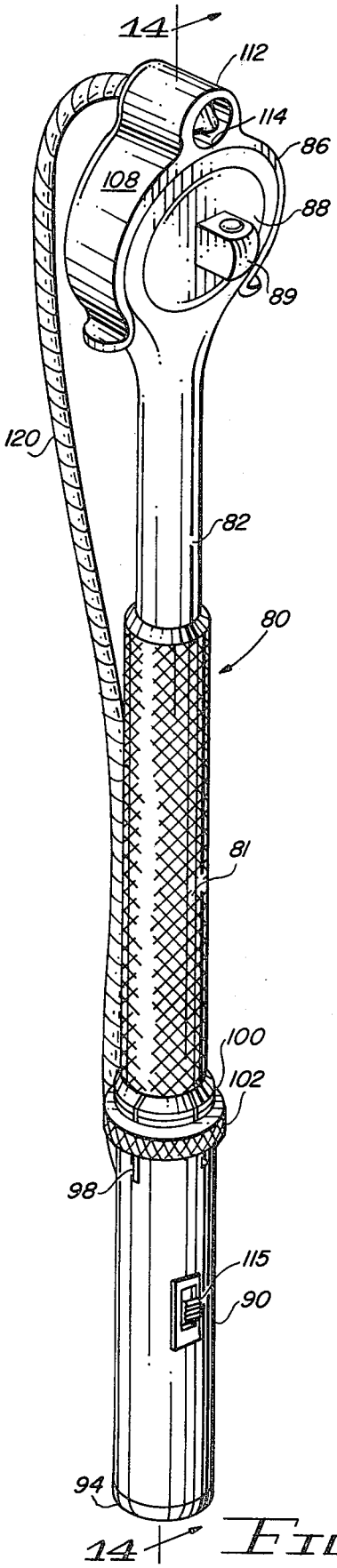
FIG. 13 is a perspective view of still another embodiment of the present invention.
Figure 14:
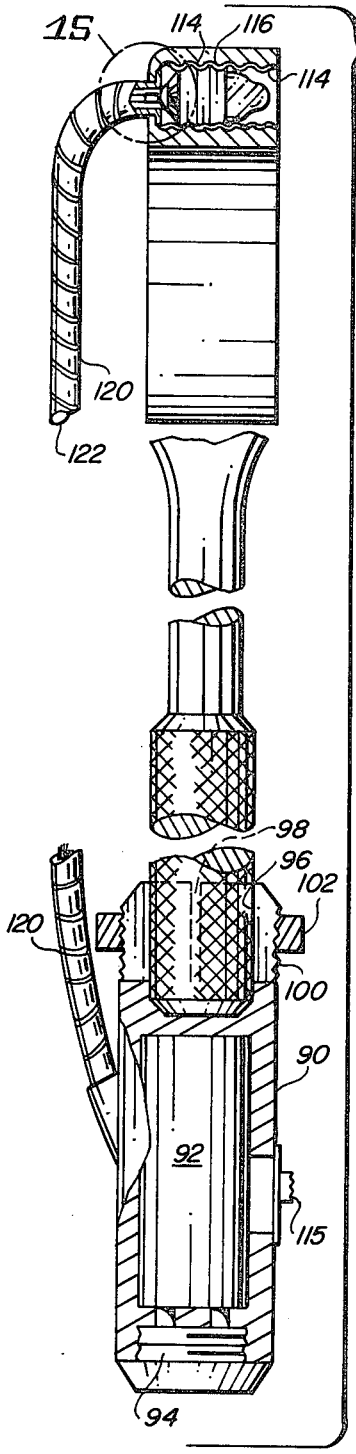
FIG. 14 is a side view of the wrench shown in FIG. 11.
Figure 15:
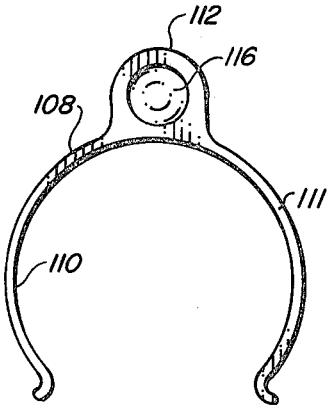
FIG. 15 is a planned view of the light clip.

In FIG. 12, ratchet wrench 150 has a head 152 within which is mounted rotatable drive 153. Drive 153 carries lug 156 defining concentric bore 157. Light source 120 is positioned in handle 121 and a beam of light is directed to bore 157 by optical light transmitting fiber 154 terminating at 155. Thus, for convenience of design and manufacture, the light source can be remotely located with illumination transmitted to the point of use.

Another embodiment of the present invention is illustrated in FIGS. 12 through 15 and is generally designated by the numeral 80. Embodiment 80 is adapted for attachment to a conventional ratchet wrench 82 having handle 81 and head 86. Head 86 carries a rotative drive member 88 having a projection lug 89. Wrench 80 includes a battery receptacle 90 which is generally cylindrical having a chamber 92 for reception of batteries. Chamber 97 is closed by a lower cap or plug 94. The upper end of the receptacle 90 defines a bore 96 which is adapted to receive the lower distal end of the handle of wrench 80. The plurality of axial grooves or slots 98 are provided in the walls of bore 96. External threads 100 extend about bore 96 and are engaged by nut 102. As best seen in FIG. 12, the lower end of the handle 84 can be inserted in bore socket 96 and nut 102 tightened to secure the socket about the distal end of a handle 84.

Light attaching clip 108 is detachably secured at head 86. Clip 108 includes opposite arm sections 110 and 111 which are of a suitable deflectable material and are positionable about head 86. A projection 112 defines a socket 114 which receives lamp or bulb 116. Flexible cable 120 interconnects socket 114 and receptacle 90 carrying suitable conductors forming a circuit operable at switch 115. It will be apparent that the battery receptable 90 and the light mounting clip 108 can be easily secured to any conventional wrench to provide illumination when necessary. When the device is not used, the clip and the battery receptacle can be removed for storage.

It will be apparent from the foregoing, the present invention provides a novel hand tool which is illuminable for the convenience of the user. The tool can be provided with illuminable means integrally formed as part of the tool or which the means can be attachably secured to the tool. The tool is inexpensive to manufacture and provides advantages not available with devices presently available in the art.

It will be apparent to those skilled in the art to make various changes, alterations and modifications to the tool described herein. To the extent these various changes, alterations and modifications do not depart from the spirit and scope of the appended claims, they are intended to be encompassed therein.

I Claim:

1. A wrench for rotating a socket or the like having a body with an elongated handle and a head at one end, said head receiving a rotatable drive member having a drive projection, a ratchet operably connectable to said rotatable drive for reversible operation thereof, the improvement therein comprising:

(a) said handle defining a battery receiving chamber for receipt of at least one battery cell;

(b) said body defining a bore generally disposed transversely to the axis of said handle;

(c) said body defining an aperture and intersecting said bore;

(d) a socket member rotatably disposed in said bore and adapted to receive a light bulb; and (e) circuit means operably connecting said socket and said battery chamber whereby said bulb can be selectively energized and said socket member rotated to direct light through said aperture to focus at a predetermined work area.

2. The wrench of claim 1 wherein said head is disposed at an angle with respect to the axis of said handle.

3. The wrench of claim 1 wherein said circuit means includes an arcuate contact strip in said bore engageable with said bulb socket in an energized position.

4. The wrench of claim 1 wherein said socket member is generally cylindrical and wherein said aperture is elongated and generally aligned with the axis of said handle.

* * * * *